United States Patent [19]

Miselli

[11] Patent Number: 4,845,921

[45] Date of Patent: Jul. 11, 1989

[54] METHOD FOR THE ECHELONED SEPARATION OF BLISTER PACKS IN A MULTI-ROW STRIP, THEIR TRANSVERSE ALIGNMENT FOR STACKING, THE ECHELONING OF THE ROWS AND THEIR LONGITUDINAL ALIGNMENT FOR CONDITIONING AND A WRAPPING MACHINE FOR PUTTING SAID METHOD INTO EFFECT

[75] Inventor: Carlo A. Miselli, Castel San Pietro Terme, Italy

[73] Assignee: I.M.A. - Industrie Macchine Automatiche S.p.A., Bologna, Italy

[21] Appl. No.: 116,484

[22] Filed: Nov. 2, 1987

[30] Foreign Application Priority Data

Dec. 29, 1986 [IT] Italy ..... 3626 A/86

[51] Int. Cl.[4] ..... B65B 11/52

[52] U.S. Cl. ..... 53/453; 53/559

[58] Field of Search ..... 53/454, 453, 560, 559, 53/540

[56] References Cited

U.S. PATENT DOCUMENTS

| | | | |
|---|---|---|---|
| 3,673,760 | 7/1972 | Canamero et al. | 53/453 X |
| 3,874,143 | 4/1975 | Braber | 53/453 X |
| 3,942,299 | 3/1976 | Bory | 53/453 X |
| 4,048,781 | 9/1977 | Johansen | 53/453 |
| 4,565,052 | 1/1986 | Hautemont | 53/453 |

*Primary Examiner*—James F. Coan

*Attorney, Agent, or Firm*—Herbert Dubno

[57] ABSTRACT

A method and a machine for putting said method into effect, for separating individual blister packs from a continuous strip of blister packs, arranged in multiple parallel rows thereon and transversely aligned, in which said individual transversely aligned blister packs are separated simultaneously in each of said rows in a respectively echeloned manner by a corresponding operational step and being thus progressively separated and echeloned are aligned transversely during the respective simultaneous advance to the corresponding stacking, and the stacks, being transversely aligned, are echeloned and aligned longitudinally in a single file for packaging into boxes or cases.

8 Claims, 5 Drawing Sheets

METHOD FOR THE ECHELONED SEPARATION OF BLISTER PACKS IN A MULTI-ROW STRIP, THEIR TRANSVERSE ALIGNMENT FOR STACKING, THE ECHELONING OF THE ROWS AND THEIR LONGITUDINAL ALIGNMENT FOR CONDITIONING AND A WRAPPING MACHINE FOR PUTTING SAID METHOD INTO EFFECT

FIELD OF THE INVENTION

The present invention relates to a method for the echeloned separation of blister packs lodged in a multi-row strip, their transverse alignment for stacking, the echeloning of the stacks and their longitudinal alignment for conditioning, as well as to a wrapping machine making up blister packs suitable for putting said method into effect.

BACKGROUND OF THE INVENTION

For the purpose of providing a blister-package making wrapping machine of the conventional type with greater operational flexibility without changing the dimensions or capability and to operate at a better production rate with regard to time as well as rendering said machine universal with regard to the variations in the dimensions of the products to be handled, the commonly assigned patent application Ser. No. 07/116,485 of the same date filed provides a wrapping machine for making up blister packs comprising two machine sections, one of which serves to form a continuous strip of blister packs by means of a stamping operation on a strip of thermoplastic material, the other for the separation of the individual blister packs from said continuous strip of blister packs and the stacking of these for their packaging and, for each of these machine sections, in particular for the stamping elements of the corresponding machine section, there is provided a separate driving means, these being phase-synchronized, in particular a "leader motor" for the downstream machine section effecting the separation, from the continuous strip, of the individual blister packs and their packaging, and a "follower motor" driving said stamping elements of the upstream machine section effecting the formation of the blisters in said continuous strip.

Essentially, in the upstream machine section effecting the stamping of the thermoplastic strip, provision is made for causing said thermoplastic strip to advance by intermittent movement and, in the downstream machine section, effecting the separation of the individual blister packs from the continuous blister pack strip and the stacking of said individual blister packs for the purpose of their subsequent packaging in boxes or cases, provision is made for operating in the form of multiple parallel rows with continuous movement.

OBJECTS OF THE INVENTION

The principal object of the present invention is to provide, within the above scope of operation in multiple parallel rows with continuous movement in accordance with the aforesaid patent application, a method for the transverse alignment of the blister packs moving in multiple rows for stacking purposes, the echeloning of said stacks for packaging, as well as a wrapping machine making up blister packs suitable for putting said method into effect.

Another object of the present invention is to provide, in accordance with the preceding object as well as with the specification of the Italian Pat. No. 1.332.245 which provides the separation of the individual blister packs from the continuous strip of blister packs without producing scrap and by means of which it is known to produce said continuous blister pack strip with multiple parallel rows of transversely aligned blister packs, a method and a machine which can separate said individual blister packs from the said continuous strip in a transversely echeloned manner and provide for their realignment in transverse direction for the stacking phase and the echeloning of the stacks as well as for the longitudinal alignment in a single file of the stacks for packaging purposes.

SUMMARY OF THE INVENTION

These and yet other objects which will become apparent hereinafter are achieved in accordance with the present invention in a method for separating the individual blister packs from a continuous blister pack strip with multiple parallel rows of transversely aligned blister packs as made up by the wrapping machine making up blister packs by conveying a continuous strip of thermoplastic material along the operating line of the wrapping machine and subjecting same firstly to a stamping operation to form lodgings or cells (blisters) therein for containing the individual products to be conditioned, then through a station for feeding into said lodgings the said products to be conditioned and from there through a station effecting the closure of said lodgings by hermetical sealing thereof, each of which lodgings contains a corresponding product, by superimposing on said strip of thermoplastic material a second continuous strip which is weldable to the first.

According to the invention provision is made successively for the simultaneous separation of the individual blister packs in each of the parallel extending rows by echeloning these respectively in a corresponding step, for the progressive transverse alignment during the simultaneous corresponding advance towards stacking, for the echeloning of said stacks and their longitudinal alignment in a single file to effect their packaging in boxes or cases.

The machine in question for making up said blister packs, which is suitable for puttiang into effect the method according to the present invention is of the type comprising two machine sections individually driven by phase-synchronised motors for forming a continuous strip of blister packs transversely aligned in multiple parallel rows.

The machine subjects a continuous strip movement to a stamping operation to form lodgings or cells (blisters) to accomodate the individual products to be packaged and with continuous feed of the products into the lodgings and continuous movement of the lodgings thus filled with the products to be pckaged to their closure by the superimposition of a second continuous weldable strip on the said first strip of thermophastic material. Separation is effected by means of sectioning elements cutting out the individual blister packs arranged in transversely aligned multiple parallel rows for the purpose of their respective stacking.

According to the invention, the cutting means are of the slicer type suitable for rhytmically separating individual blister packs simultaneously in each of said parallel rows in a respectively echeloned manner by a corresponding pass. Transport means are provided capable of progressively aligning in transverse direction the said individual blister packs during their respective simultaneous advance.

The machine also includes means for stacking the individual successive blister packs of each transversely aligned row, means for echeloning (offsetting or staggering) the stacks by responding step said stacks and means for aligning longitudinally in a single file the said stacks thus echeloned for their packaging in boxes or cases.

BRIEF DESCRIPTION OF THE DRAWING

Further features and advantages of the method and the wrapping machine according to the present invention will be clearly apparent from the following detailed description of one of their preferred but not exclusive form of embodiment given here solely by way of non-limiting example with reference to the accompanying drawing in which.

SPECIFIC DESCRIPTION

Figure 1:
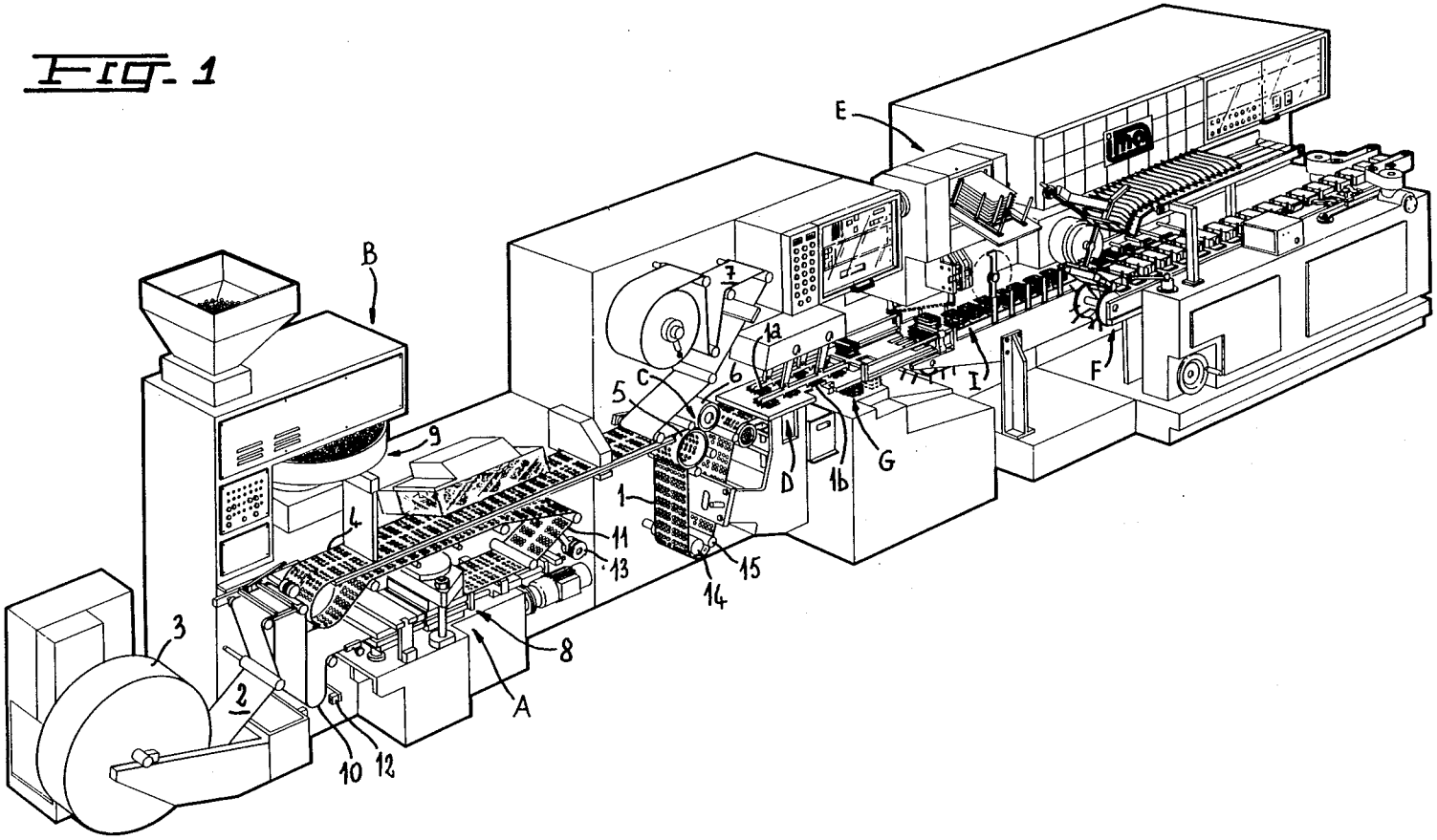
FIG. 1 is a perspective view of the front-side elevation of the wrapping machine described in the aforementioned copending application.
Figure 2:
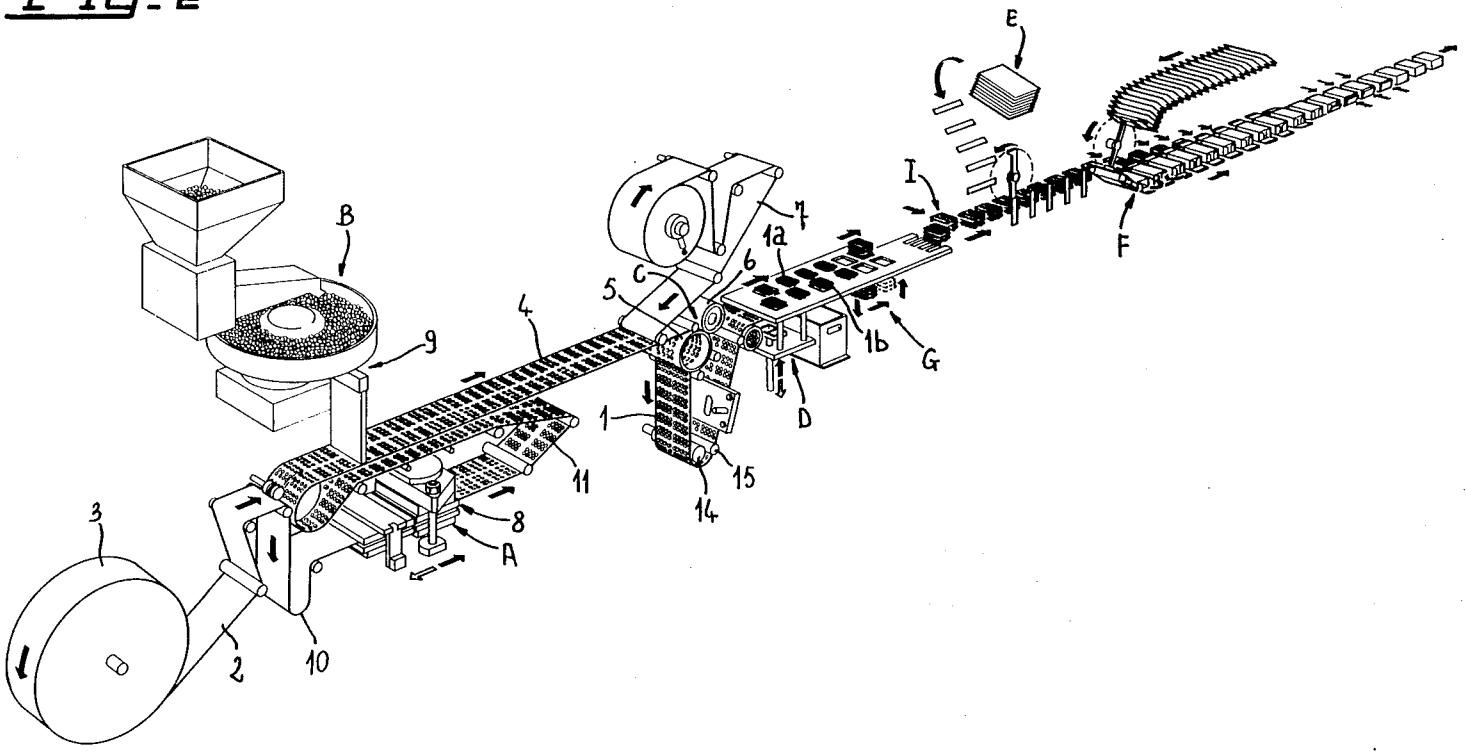
FIG. 2 is a diagrammatic, perspective view in front-side elevation, of the operating line of the machine of FIG. 1 according to the invention.

Essentially, the machine for producing blister packs concerning the present invention, of the type of which the production track according to the aforecited patent application is illustrated in FIG. 1 for the formation of a continuous strp 1 of blister packs in multiple parallel rows and for the separation of the individual packs from the said strip 1, and the eventual stacking and the transport of the individual blister packs for there packaging in boxes or cases, said continuous blister pack strip (see FIGS. 1 and 2) being obtained by causing to move along the horizontal operating track of the machine a strip 2 of thermoplastic material drawn from a roll 3 and subjected to a series of operations along the said operating line in accordance with the various operating stations of the said wrapping machine. The foil is subjected at station A to the action of stamping means to form therein, in transverse and longitudinal alignment by stamping two parallel series of lodgings (blisters) 4 to accommodate the individual products to be packed and from there is drawn by drawing rollers 5, 6, through a station B where the products to be packed are fed into said blisters. The foil is the panel through a station C for the closure by hermetical sealing of said blisters 4 each of which contains one of the products to be conditioned, by the superimposition on the strip 2 of thermoplastic material thus formed and thus filled with the products to be packed, of a second strip 7, usually of aluminum, weldable to the strip 2 of thermoplastic material, thus obtaining a continuous strip 1 of blister packs arranged in multiple parallel rows.

Such a continuous strip 1 of blister packs then reaches a station D of the machine for its separation into individual blister packs 1*a* and 1*b* and the latter move to a station G for stacking in parallel rows and then to a station I where the longitudinal alignment into a single file is effected, to move therefrom to the station F for packing into containers, after passing first through a station E where an element checking the condition of the product is operative.

A machine thus constructed is provided with a synchronized plural drive means so as to advance the strip 2 through the station A with intermitten movement or in successive steps for the stamping out therein of lodgings 4 by stamping means 8 and then, thus provided with lodgings, through the station B for the introduction into said lodgings the products to be packed and subsequently through the station C effecting the closure by sealing the products into said lodgings in a continuous movement, creating a bend or a loop 14 controlled by a control device 15, independently of the synchronized plural drive means, moving to the station D for the division of the continuous blister pack strip into individual blister packs 1*a*, 1*b* in multiple parallel rows in a continuous movement. From there, see the aforementioned patent application through the aforesaid stations G for stacking, I for the alignment of the stacks into a single file and the above mentioned packaging stations E and F.

Figure 4:
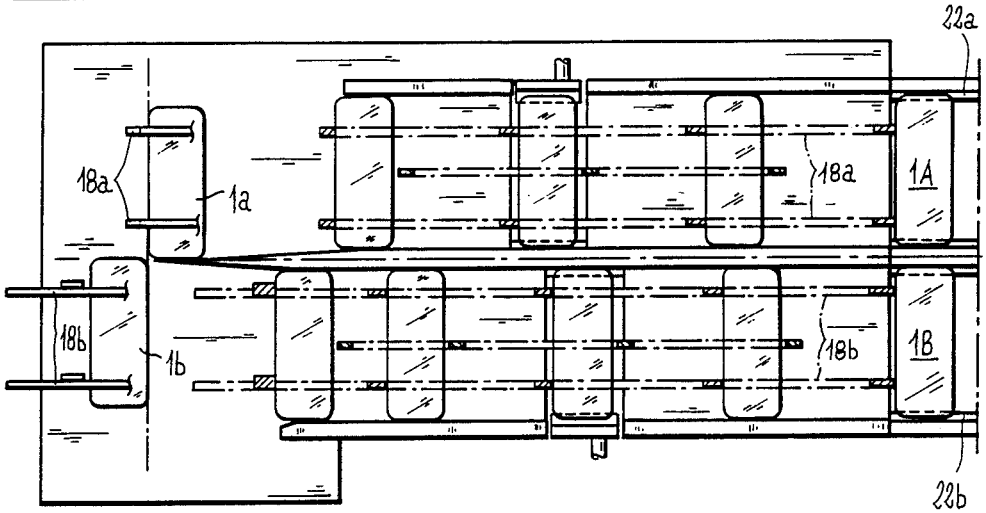
FIGS. 4, 5, 6 and 7 illustrate details of FIG. 3 on a more enlarged scale and electrical circuit diagrams.

According to the invention, the division of said continuous blister pack strip 1, in which said blisters are provided, by way of example, in two parallel rows and transversely aligned, is carried out in accordance with Italian Pat. No. 1.332.245, which provides for the separation of the individual blister packs from the continuous blister pack strip without producing scrap, providing step by step for the simultaneous separation of the individual blister packs 1*a* and 1*b* in each of these parallel-oriented rows in a respectively echeloned manner in a corresponding step (see FIG. 4). The resulting blister packs thus arranged in succession are then, according to the method of the present invention, progressively aligned transversely during their simultaneous respective advance (see again FIG. 4) toward their corresponding stacking in a pre-arranged number as will be better apparent from the following (see in this context FIGS. 1, 2 and 6). The resulting respective stacks, 1A and 1B, transversely aligned (see FIGS. 4 and 6) in accordance with the method in question, are caused to move forward so as to be echeloned or staggered in two parallel rows, see in particular FIG. 2, station I, where such stacks are aligned longitudinally in a single file and are thus caused to pass through station F for packing in cases, after first passing a station E where an element controlling the condition of the product to be conditioned.

The machine for putting into effect such a method according to the present invention provides, at station D (FIGS. 1 and 2) for the separation of the individual blister packs 1*a* and 1*b* (see FIG. 4), sectioning means generally referenced 16 (see in particular FIG. 3) having two cutting elements 17 arranged in the direction of advance of the blister pack strip 1, for cutting laterally transverse sections staggered in longitudinal direction in a single step. Downstream of the cutting elements 17 are arranged two series of double racks 18*a*, 18*b* of a known type, actuated in their orbital reciprocating motion by a parallelogram linkage 19 of a rod and crank system 20. The teeth of the two racks 18*a*, 18*b* of each series are arranged in such a manner that during their movement effecting the advance of the successive individual blister packs 1*a*, 1*b*, respectively, provide for the gradual transverse alignment of the latter (see in particular FIG. 4) causing these to slip step by step, accompanied by a corresponding plate each 21*a*, 21*b* in alternating vertical movement in a corresponding lodging 22*a*, 22*b* therebelow, only one of which is visible in FIG. 3, referenced 22*b*, and also schematically in FIG. 6, for effecting the respective stacking in the desired numbers, as will be seen in the following.

Figure 3:
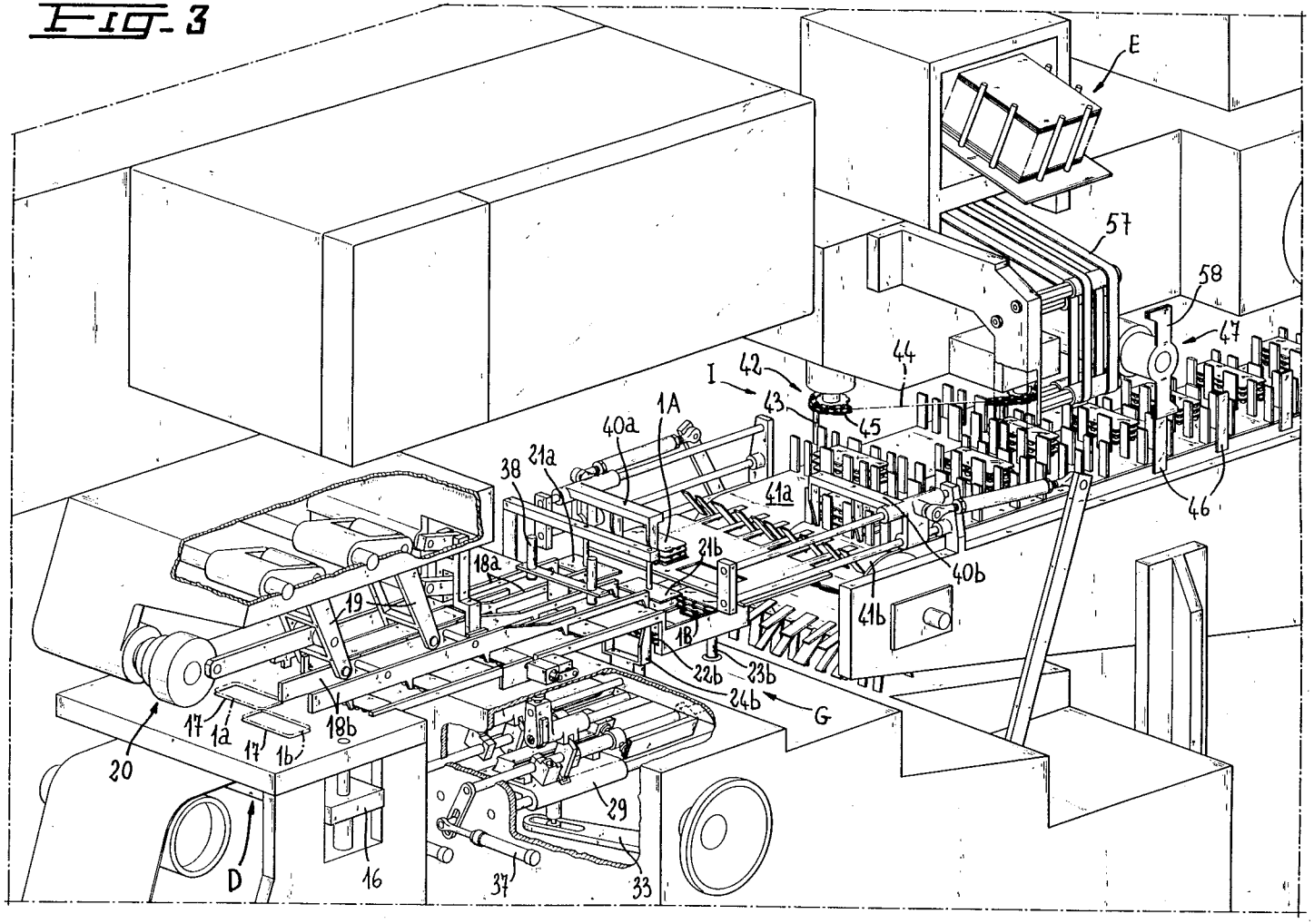
FIG. 3 shows, again in a perspective view in front-side elevation, that part of such a machine on an enlarged scale which relates to the present invention.
Figure 5:
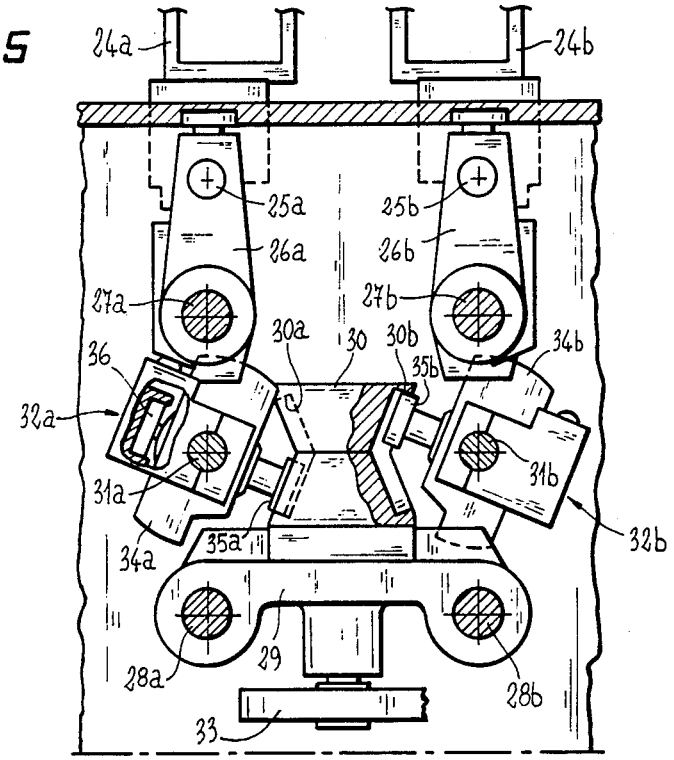
Figure 6:
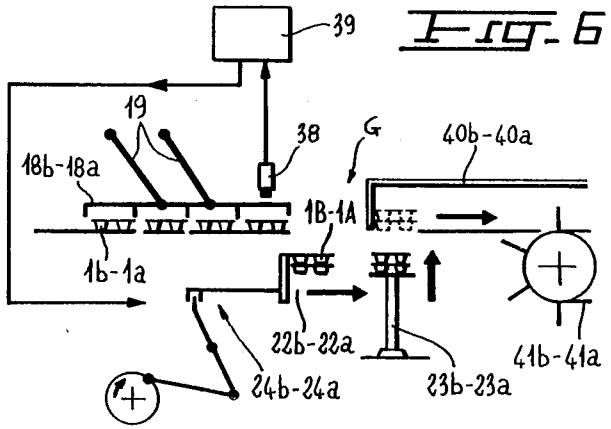

The stacks 1A and 1B (see FIGS. 3 and 6) thus obtained in said lodgings 22*a*, 22*b* are transferred onto a corresponding elevator 23*a*–23*b*, of which again only elevator 23*b*, is visible in FIG. 3 and schematically in FIG. 6, by means of a corresponding pusher 24*a*, 24*b*, see FIGS. 5, 6 and 3.

The said pushers 24*a*, 24*b* are each constituted by a pusher head mounted on a horizontal bolt 25*a*, 25*b*, respectively, see FIG. 5, the other extremity of which engages a corresponding member 26*a*, 26*b* mounted slidably on a corresponding horizontal axle 27*a*, 27*b*.

Underneath these two horizontal axles 27*a*, 27*b* are provided two further horizontal axles 28*a*, 28*b* on which in turn is slidably mounted a member 29 to which is fastened an extension 30 of a substantially X-shaped cross-sectional form, having longitudinally inclined lateral guide tracks 30*a*, 30*b* along the flanks of said X.

Between these two couples of horizontal axles 27*a*, 27*b* and 28*a*, 28*b* are arranged two further horizontal axles 31*a*, 31*b* on oscillating supports on which there is mounted a corresponding small block each, generally referenced 32*a* and 32*b*, respectively, capable of operatively interconnecting, in the presence of a blister-pack or as a consequence of a scrap of blister pack in the corresponding row, the members 26*a*, 26*b* of the pushers 24*a*, 24*b* with the member 29 actuated in its reciprocating movement by an actuating lever 33 (see FIG. 3) of a control system of the machine here not shown.

Each of the said small blocks 32*a*, 32*b* comprises a plate-shaped element 34*a*, 34*b* permanently fixed with one of its extremities displaceably to the corresponding member 26*a*, 26*b* and, with its other extremity, capable of engaging at least the said member 29 (see FIG. 3) following exactly the presence of blister packs or scraps thereof as will be better apparent from the following. The blocks 32*a*, 32*b* are furthermore each provided with a corresponding track following roller 35*a*, 35*b* engaging into said guide tracks 30*a*, 30*b* and with a corresponding counter-roller 36. The engaging movement of the corresponding extremity of the plate-shaped elements 34*a*, 34*b* with the member 29 causes to oscillate the respective axles 31*a*, 31*b* by means of a command to a corresponding hydraulic actuator cylinder 37 given in the following manner (see FIGS. 3, 4 and 6).

As stated above, the blister packs 1*a*, 1*b* are cut two at a time and are caused to advance in two parallel files from the racks 18*a*, 18*b* into the stacking lodgings 22*a*, 22*b*. Over each file of these blister packs 1*a*, 1*b* is arranged a photocell 38 (see FIG. 6) in front of the stacking lodgings 22*a*, 22*b*, capable of detecting the passing of the individual blister packs. The signals of the photocell 38 increment a counter 39 programmed for the desired number of blister packs in the corresponding stack. Once the stack is complete as at 1A, 1B, the output signal of said counter 39 operates the said hydraulic actuator cylinder 37 to interconnect, by means of the above-described coupling, the plate-shaped elements 34*a*, 34*b*, the corresponding pushers 24*a*, 24*b* to the said member 29 causing the stack to advance to the corresponding elevators 23*a*, 23*b*. This movement of the pushers 24*a*, 24*b* is effected, in advance and return, in a time shorter than that of a blister pack, namely that of the pusher returning into its rest position before the first blister pack of the next stack is transported from the racks 18*a*, 18*b* to the stacking lodgings 22*a*, 22*b*. Back in their rest positions, the pushers 24*a*, 24*b* are disengaged from the member 29 when the stack of blister packs is completed.

Figure 7:
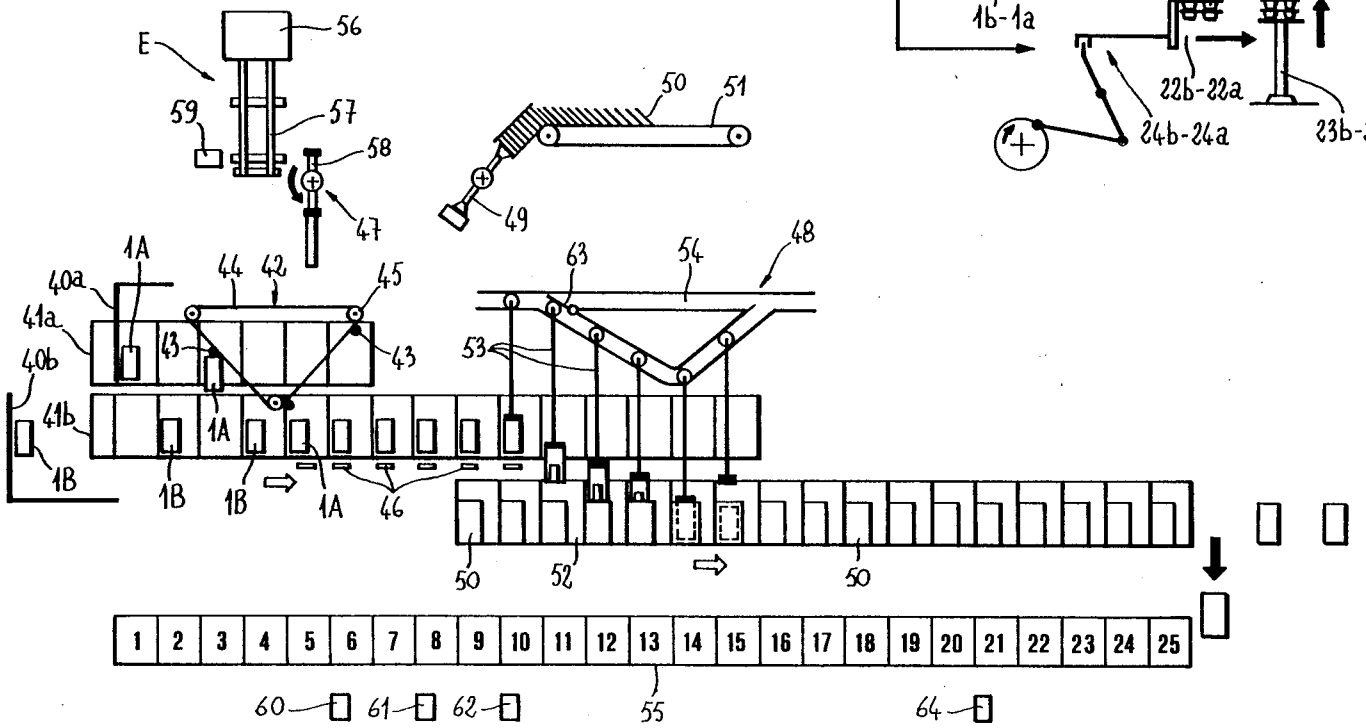

The elevators 23*a*, 23*b* are actuated in their alternating up and down movement so as to be set off by 180° of the machine cycle so as to give room for the echeloning of the respective stacks 1A, 1B in the course of their transfer by means of the accompanying assemblers 40*a*, 40*b*, these being also operated in phases of 180° of the machine cycle, for introduction into the corresponding boxes in a respectively echeloned manner by a corresponding number of continuously moving box transporters 41*a*, 41*b* (see in particular FIGS. 3 and 7).

Assembler means 42 with pushing rods 43 carried by chain assemblies 44 moving in closed cycle with continuous movement on chain pulleys 45 (see FIGS. 3 and 7) provide for the insertion of the stack 1A of the transport block carrier 41*a* into the empty boxes between which is contained the stack 1*b* of block transporter 41*b*, aligning the stacks 1A and 1B in a single longitudinal file for their packaging (see FIG. 7). With each of these stacks 1A and 1B thus aligned in a single longitudinal file within the blocks there is traditionally associated a brochure 46 (see again FIG. 7) by means of a conventional apparatus referenced 47 in FIG. 7 and thus packaged into containers. For this last-mentioned packaging operation there is provided a conventional apparatus generally shown at 48 in FIG. 7 which comprises, essentially, a head 49 for picking up cases 50 from a store 51 and for feeding, in a predetermined manner, these into successive boxes of a case transporter in continuous movement 52 parallel to the box transporters 41*a* and 41*b* previously mentioned. Movable pusher elements 53 in continuous movement along a closed circuit 54 provide for the insertion of the individual stacks 1A, 1B with associated brochures 46 by transfer from transporter 41*b* into the cases 50 located on box transporter 52.

The operation of stacking and of aligning the stacks into a single longitudinal file are controlled by the above described control circuit with reference to FIG. 6 in combination with another one here not shown which together provide the information of the presence of the stacks in the boxes of the box transporters 41*a* and 41*b*. This data, through a shift register 55, is suitably transmitted to the pickup control for the brochure 46 from the store 56 of the device 47.

When brochures 46 are picked up they are transported by a belt device 57 to a rotary head 58 fitted with pincers which effects its transfer to a pincer of the corresponding box containing the stack, where in the case of absence of a stack the brochure feed to the corresponding box is stopped.

Along the course covered by the prospectuses an optical head 59 can be mounted, which, in combination with an electronic device could control the optional code of the brochure, and a photocell 60 checking the effective provision of the prospectus, stage 6 of the shift register 55, which operates relative to the stack concerning the brochure corresponding to the box of stage 5. With regard to the box relative to stage 8, a proximity detector 61 controls the effective presence of the stack.

The three sets of data: presence of the brochure, correct coding of the latter and presence of the stack are fed to the control apparatus which gives the signal for the pickup of the box or case 50 to the corresponding stage of the ninth box only when all three conditions regarding the pickup are satisfied. In the contrary case the pickup head 49 is inhibited. At the level of the stage of the tenth box, a photocell checks the effective transfer of the box to the case. This condition, added to the three previous ones, makes possible the operation of a mechanical deviating means 63 which guides the pusher elements 53 of the product to be packaged. If any one of the above mentioned conditions, namely presence of the brochure, correct coding of the latter, presence of the stack, presence of the box is not verified, the deviator 63 changes positions and the pushers 53 in transit will not carry out feeding functions until there pass such boxes which satisfy all the above conditions. A successive control regarding the eventual coding of the box is effected by the photocell 64 to the stage 21 of the corresponding box in conjunction with the relevant electrical device. The good or poor data are transmitted to the last stage of the shift register 55 from which authorizes valid packaging continuation for the subsequent treatment for retail distribution, while an erroneous coding acts on a mechanical arrester which shunts the electrical system towards a reject store.

I claim:

1. A method of packaging comprising the steps of:

(a) intermittently advancing a base thermoplastic strip along an operating line;

(b) forming first and second rows of longitudinally aligned blisterpacks, each of said blister packs comprising a plurality of cells in said base strip, each blister pack of the first row being transversely aligned with a respective blister pack of the second row;

(c) filling said cells with a product to be packaged and moving said base strip further along said line;

(d) hermetically sealing said cells of said rows of the blister packs with a covering continuous strip thermally weldable to said base strip to form a welded strip of said blister;

(e) progressively advancing said welded strip;

(f) cutting said welded strip to individual blister packs, thereby forming two parallel longitudinally aligned rows of said individual blister packs;

(g) periodically forming first and second stacks of said individual blister packs in respective parallel rows, each stack comprising a predetermined number of said individual blister packs, and with said stacks of said rows being laterally offset with respect to the stacks of the row so that each stack of one row is located between two consecutive stacks of the second row; and (h) continuously longitudinally aligning said rows of said stacks by guiding each stack of one of said rows of stacks transversely between respective consecutive stacks of the other row of stacks packaging in boxes.

2. The method defined in claim 1 wherein, prior to formation of said first and second stacks in respective rows, the individual blister paks in respective rows are staggered so that a blister pack of one row is attached along said path at a location between blister packs of an adjoining row.

3. An apparatus for producing and packaging blister packs comprising:

means for advancing a base thermoplastic strip along an upstream part of a transport path;

means for simultaneously forming two parallel rows of blister packs in said strip with each of said blister packs of one of said rows being transversely aligned with a respective blister pack of the other row;

means along said path for filling said blister packs with a product;

means for applying a covering strip to said base strip, and for welding said cover strip to said base strip, thereby sealing said blister packsand forming a welded strip;

means for simultaneous cutting said welded strip into individual blister packs and advancing said blister packs along said path;

means along said path for stacking said individual blister packs periodically and simultaneously forming two rows of stacks of said individual blister packs with each stack of one row of stacks being offset relative to the stacks of the other row of stacks, so that each stack of one of said rows of stacks is advanced along said path between two consecutive stacks of the other row of stacks; and means for aligning the stacks of said two rows of stacks by moving each stack of one of the rows of stacks transversely to said path, so that said stacks of said one row is placed between respective consecutive two stacks of the other row in a single row of stacks.

4. The apparatus defined in claim 3 wherein said means for stacking comprises:

an actuating lever oscillating about a pivot axis perpendicular to said path;

support means connected with said lever and reciprocatable thereby parallel to said path;

a guide having a X-shaped cross-section on said support means, said guide having inclined said guide tracks;

two shaped plates guided along respective guide tracks of said guide; and two pushing elements spaced apart and slidably mounted on respective sliding axes perpendicular to said pitot axis, said elements being connected with the respective shaped plate, so that said support means moves the respective pushing element advancing the respective stack of blister packs.

5. The apparatus defined in claim 3 wherein said cutting means are slicer type means separating individual blister packs from said welded base and covering strip simultaneously in each of said parallel rows.

6. The apparatus defined in claim 3, further comprising means for packaging said stacks from said single row into respective boxes along said path.

7. The apparatus defined in claim 3 wherein said means for aligning comprises a plurality of parallel rods movable perpendicular to said path by a closed cycled chain continuously moving on sprockets.

8. The apparatus defined in claim 3, further comprising means for indicating a predetermined number of individual blister packs in said stacks above the respective means for stacking operatively connected therewith.

* * * * *